US005242145A

United States Patent [19]

Linnell

[11] Patent Number: 5,242,145

[45] Date of Patent: Sep. 7, 1993

[54] ADJUSTABLE ARTIST'S EASEL

[76] Inventor: Lloyd Linnell, P.O. Box 30, Denmark, Mass. 04022

[21] Appl. No.: 908,385

[22] Filed: Jul. 6, 1992

[51] Int. Cl.[5] ..... A47B 97/04

[52] U.S. Cl. ..... 248/449; 248/454; 248/460

[58] Field of Search ..... 248/449, 454, 455, 456, 248/457, 460, 462

[56] References Cited

U.S. PATENT DOCUMENTS

| | | | |
|---|---|---|---|
| 498,578 | 5/1893 | Schmirk | 248/449 |
| 1,782,118 | 11/1930 | Cahall | 248/449 |
| 1,847,195 | 3/1932 | Robinson | 248/454 |
| 2,879,008 | 3/1959 | Boychick | 74/557 X |
| 3,899,164 | 8/1975 | Newman | 248/454 X |
| 4,165,856 | 8/1979 | Wiseheart | 248/455 X |
| 4,610,414 | 9/1986 | Schuck | 248/449 |
| 4,703,910 | 11/1987 | Ross | 248/449 X |
| 4,726,556 | 2/1988 | Weir | 248/454 |

*Primary Examiner*—J. Franklin Foss
*Attorney, Agent, or Firm*—Frederick R. Cantor

[57] ABSTRACT

An adjustable artist's easel, that includes a base, an upwardly extending pedestal, a picture frame support panel, and an articulated arm structure, extending between the pedestal and the panel. The frame support panel can be tilted around its point of connection to the articulated arm structure. Additionally, the frame support panel can be raised or lowered to various different positions, such that an artist can use the adjustable easel, in either a standing position, or a seated position. As an optional embodiment, the easel can be readily equipped with a painting materials tray, in the space below the picture frame support panel.

12 Claims, 4 Drawing Sheets

ADJUSTABLE ARTIST'S EASEL

BACKGROUND OF THE INVENTION

The present invention relates to adjustable artist's easels.

The present invention more particularly relates to adjustable artist's easels, that can be readily adjusted to support a picture frame in various different positions, according to the individual requirements of different artists.

A conventional artist's easel, in most cases, comprises an upright tripod construction, wherein the two front-most tripod legs, also form a support surface for a picture frame, that also anchors the canvas on which the painting is to be made. Further, a transverse bar extends across the two front-most tripod legs to supportively engage the lower edge of the picture frame.

The tripod legs are angled to a vertical plane so that the canvas picture frame is tilted to a stable condition, resting against the two front-most tripod legs.

Most conventional artist's easels are not sufficiently adjustable to fully meet the needs of a wide range of different artists, e.g., to support the canvas frame in an elevated position, or lowered position, so that the artist can conveniently paint while either standing or sitting, or to permit the canvas picture frame to have a wide range of tilted positions, between the vertical position and the horizontal position The present invention, has elegantly overcome the drawbacks of the prior art conventional artist's easels, by providing an adjustable artist's easel, designed to achieve an increased degree of versatile adjustability, for meeting a wide range of an artist's needs.

SUMMARY OF THE INVENTION

An object of the present invention, is to provide an adjustable artist's easel

An object of the present invention is, more particularly, to provide an adjustable artist's easel, that can be readily adjusted to support a picture frame in various different positions, according to the individual requirements of different artists Another object of the present invention, is to provide an adjustable artist's easel, that includes a base, and a pedestal extending upwardly, from the base, to support an articulated arm structure. A picture frame support panel, has a pivotable connection with the free end of the articulated arm structure, such that the support panel, and associated canvas, or picture frame, can be tilted to different inclined positions, ranging from an essentially vertical position, to an essentially horizontal position. The horizontal position is useful when the artist is painting with watercolors, as the relatively thin, nonviscous, watercolor paints, will then stay in place on the canvas, without running down along the canvas surface.

The articulated arm structure can be readily moved, and/or folded, so that the canvas or picture frame support panel, can be raised or lowered, while still permitting the aforementioned tilting adjustments. With the canvas support panel in a raised position, the artist can paint while standing; when the support panel is lowered, the artist can paint in a seated position The major aim of the present invention, is to provide a highly adjustable artist's easel, that will appeal to a wide range of different artists, having a plurality of different working preferences, and painting habits.

Conventional artist's easels, usually have no provision for supporting paints, brushes, and implements, in close proximity to the canvas surface. The easel of the present invention, includes a painting materials tray, that is located just below the canvas or picture frame support panel, such that the artist has quick and easy access to the various brushes, paints, thinners, knives, etc., used in the selected painting process. The painting materials tray, is adjustably mounted, so that it can be moved forward or rearward, and also up or down, to the desired most convenient position, for the individual artist.

The adjustable artist's easel of the present invention, is preferably designed, so that it can be readily used by a person sitting, either in a regular chair, or in a wheelchair. When used by a person in a wheelchair, the adjustable easel, will be adjusted, so that the aforementioned articulated arm structure, is extended forwardly, to a point beyond the base, such that the wheelchair, can then be moved into a position below the overhanging canvas frame support panel, where the artist can then apply paint to the canvas, without needing to reach or stretch his/her arms, or torso, while painting.

In summary, and in accordance with the above description and discussion, the foregoing objectives are achieved in the following embodiments.

1. An adjustable artist's easel, comprising, a base; a pedestal, extending upwardly from said base; said pedestal, having an upper end; an arm structure, having a first pivotable connection to the upper end of said pedestal; said arm structure, having a free end; and a picture frame support means, having a second pivotable connection to said free end of said arm structure; the axes of said pivotable connections, extending parallel to meet each other, and to the plane of the picture frame support means, whereby, said picture frame support means, can be tilted to different inclinations around said second pivotable connection, and, whereby, said picture frame support means, can be raised or lowered, such that an artist can use said easel, while standing or sitting.

2. The adjustable artist's easel, as described in paragraph 1, wherein each pivotable connection, further comprises, a pivot pin, having a headed end and a threaded end, and a clamping nut, having a non-circular handle, that is turnable, to apply, or remove, the clamping force; and a separate elongated lever, having a socket opening therein mated to each said non-circular handle, whereby said lever, can be installed onto each handle, to provide an increased turning torque.

3. The adjustable artist's easel, as described in paragraph 1, wherein said arm structure, further comprises, two elongated arm mechanisms, having a swingable connection therebetween, whereby said arm structure is articulated, for varying the spacing between said first and said second pivotable connections.

4. The adjustable artist's easel, as described in paragraph 3, and further comprising, a painting materials tray, having a front end and a rear end; and, a depending link means, having an upper end thereof connected to said second pivotable connection; said link means, having a third pivotable connection to said rear end of said tray, whereby said tray, can be held in a horizontal position, irrespective of the inclination, or elevation, of the picture frame support means.

5. The adjustable artist's easel, as described in paragraph 4, and further comprising, an adjustment slot means, extending along said link means, whereby said tray, can be raised or lowered along said link means, without changing the position of said picture frame support means.

6. The adjustable artist's easel, as described in paragraph 5, wherein said depending link means, is independently swingable around said second pivotable connection, whereby said tray can be adjusted in a front-to-rear direction, while maintaining a horizontal position, below said picture frame support means.

7. The adjustable artist's easel, as described in paragraph 3, wherein said picture frame support means, further comprises, a rectangular panel, having a lower end and an upper end; said panel having a front surface, adapted to receive a picture frame thereon, and a rear surface, having a strut means extending away from the panel plane at an intermediate point between the upper and lower ends of said panel; said second pivotable connection, being located between said arm structure and said strut means.

8. An adjustable artist's easel, comprising, a base; a pedestal extending upwardly from said base; said pedestal comprising two sets of spaced apart pedestal elements, each set comprising three closely spaced pedestal elements; an articulated arm structure, having a first pivotable connection to the upper end of said pedestal; said articulated arm structure comprising two sets of spaced apart lower arms, and two spaced apart upper arms; each set of lower arms comprising two closely spaced arms, having their lower ends fitting between the upper ends of a corresponding set of three pedestal elements; said spaced apart upper arms, having lower ends thereof fitting between the upper ends of a corresponding set of lower arms; and a picture frame support means, having a second pivotable connection with said articulated arm structure; said picture frame support means comprising a rectangular panel, having a front surface and a rear surface, and two spaced apart struts, extending from the panel rear surface; said struts having end portions thereof overlapped with end portions of said upper arms to form said second pivotable connection; said pivotable connections being parallel to each other and to the plane of said picture frame support panel, whereby said support panel, can be tilted, and, also raised or lowered, so that an artist can use the easel while standing or sitting.

9. The adjustable artist's easel, as described in paragraph 8, and further comprising, a painting materials tray, having a front and rear end, said tray comprising two spaced apart bars; and a depending link means for suspending said tray below the picture frame support panel; said link means comprising two spaced apart link elements, having upper ends thereof overlapped with end portions of said upper arms, in order to form a swingable connection between said articulated arm structure and said depending link means; said tray support bars having end portions thereof overlapped with said link elements to form a second swingable connection between said link means and said tray, whereby said tray can be adjusted in a front-to rear direction, while maintaining a horizontal position below said picture frame support panel.

10. The adjustable artist's easel, as described in paragraph 9, and further comprising, an adjustment slot means, extending along each depending link means, whereby said tray can be raised, or lowered, along said link means, without changing the position of the picture frame support panel.

11. The adjustable artist's easel, as described in paragraph 8, wherein said first pivotable connection, further comprises, two separate pivot pins, each said pivot pin, extending transversely through said three pedestal elements and two associated lower arms; said second pivotable connection, further comprising, two separate pivot rods, each said pivot rod, extending transversely through one of said struts and associated said upper arms.

12. The adjustable artist's easel, as described in paragraph 8, wherein said articulated arm structure, includes a swingable connection, between said lower arms and said upper arms, whereby said arms can be folded, or unfolded, to vary the spacing between said first and said second pivotable connections.

13. The artist's easel, as described in paragraph 8, wherein said picture frame support panel, has openings therein, enabling the easel to be folded into a storage-ready condition, wherein said lower arms, extend generally parallel to said base, and said upper arms extend from said lower arms, angularly toward the base, and said panel extends angularly in intersecting relation to said upper arms and said lower arms.

DESCRIPTION OF THE PREFERRED EMBODIMENTS OF THE PRESENT INVENTION

Figure 1:
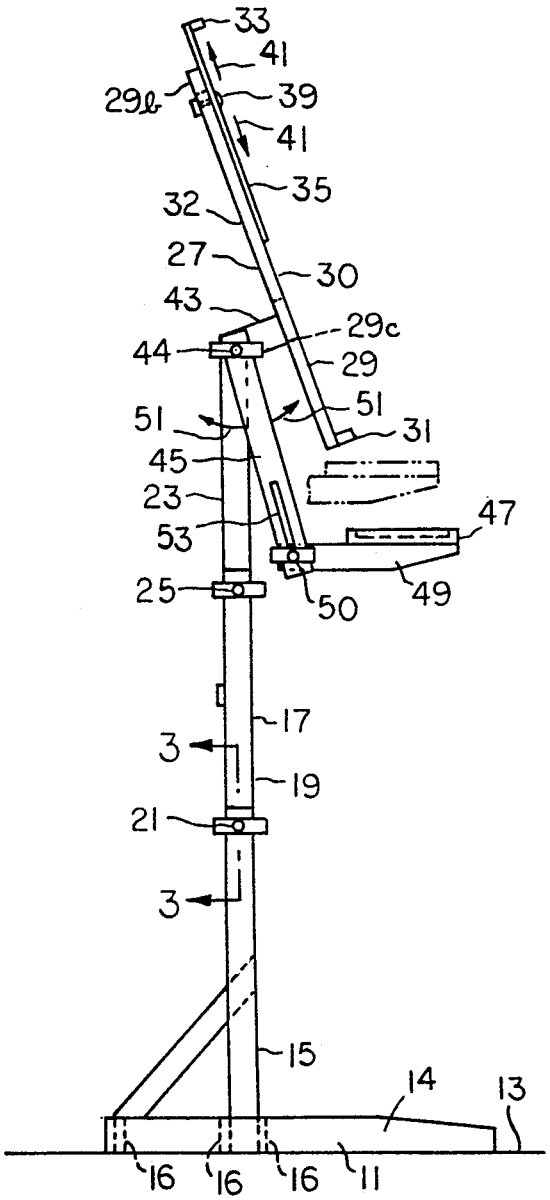
FIG. 1, is a side elevational view, of an adjustable artist's easel, constructed according to the present invention.

FIG. 1, is a side elevational view, of an adjustable artist's easel, constructed according to the present invention.

Figure 2:
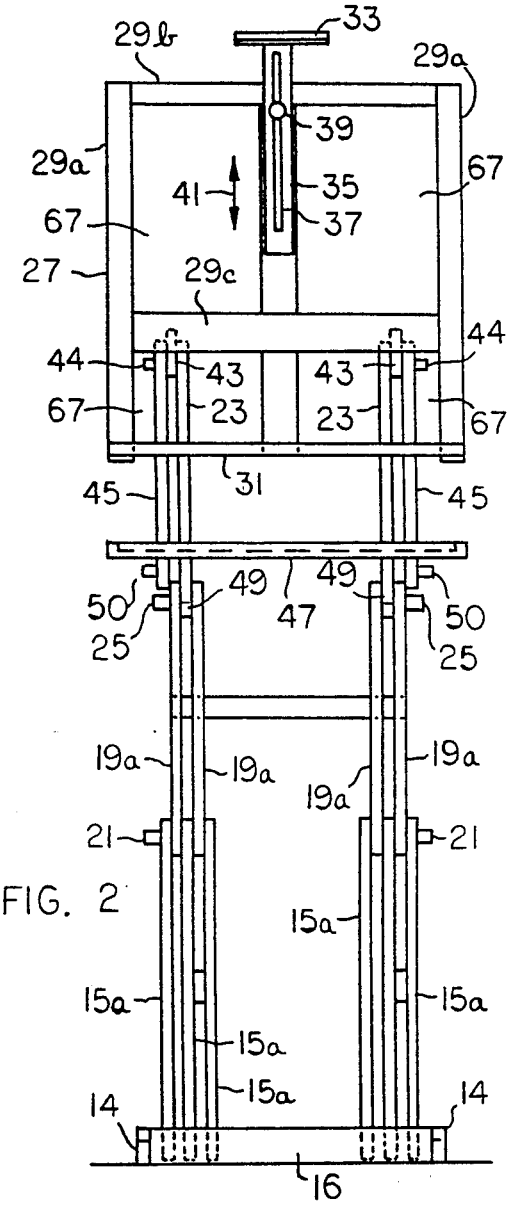
FIG. 2, is a front elevational view, of the FIG. 1 artist's adjustable easel.

FIG. 2, is a front elevational view, of the FIG. 1 adjustable artist's easel.

Referring now to FIG. 1, there is shown an adjustable artist's easel, that includes a horizontal base 11, adapted to rest on a ground, or floor, surface 13. A vertical pedestal 15, extends upwardly from base 11, to mount an articulated arm structure 17. Arm structure 17, comprises a lower arm mechanism 19, having a pivotable connection 21, with pedestal 15, and an upper arm mechanism 23, having a swingable connection 25, with lower arm mechanism 19.

A picture frame support means 27, is supported by the free end of upper arm mechanism 23. Support means 27, includes a planar edge panel 29, having a ledge bar 31, attached to its lower edge, for supporting the weight of the canvas picture frame, not shown. The picture frame is clamped to panel 29, by an upper bar 33, extending transversely across a thin mounting strip 35, that rests against the front face of panel 29. Upper bar 33, and strip 35, form a T-shaped frame clamp mechanism, as viewed in FIG. 2.

As shown in FIG. 2, strip 35, has a longitudinal slot 37, extending therealong, adapted to receive the shank portion of a fastener element 39, whereby the mounting strip can be adjusted along panel 29, as indicated by arrows 41, to adjust the position of bar 33. The canvas, or picture frame (not shown), is placed on the front face 30, of panel 29, with its lower and upper edges clamped between bars 31 and 33.

Figure 7:
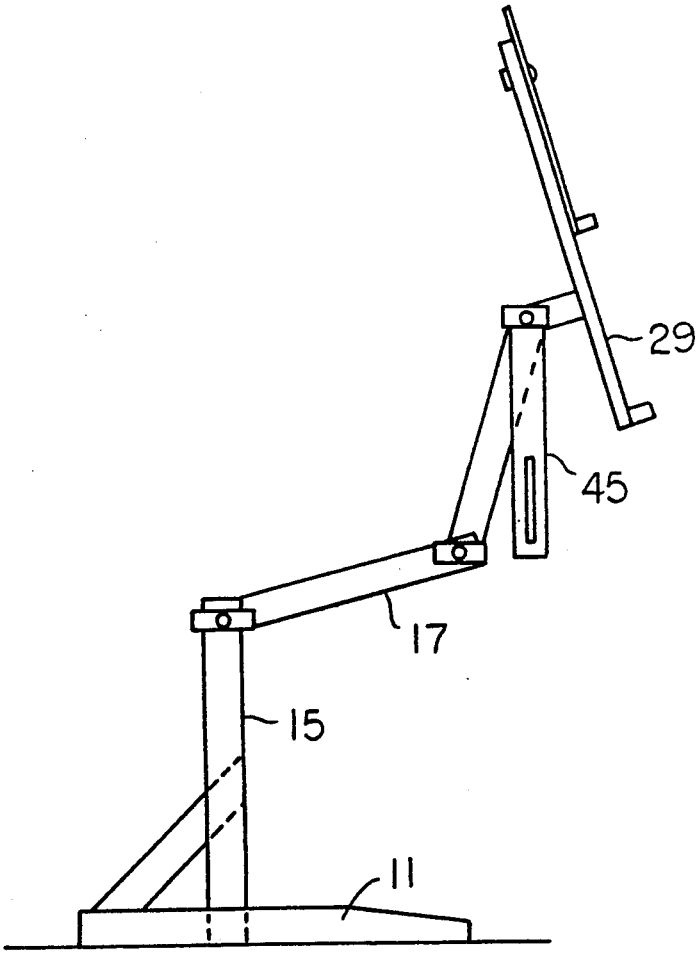
FIG. 7, is a view, taken in the same direction as FIG. 1, but showing the easel in a position suited for use by an artist, seated in a wheelchair.

FIG. 7, is a view, taken in the same direction as FIG. 1, but showing the easel in a position suited for use by an artist, seated in a wheelchair.

In order to accommodate shorter picture frames, the T-shaped frame clamp mechanism, 33 and 35, can be reversed on panel 29, so that bar 33, is at the lower end of strip 35, as shown in FIG. 7. The picture frame is positioned on the front face 30, of panel 29, between bars 31 and 33.

Panel 29, has a strut means 43, extending from its rear face 32, for pivotable connection, as at 44, with the upper end of upper arm mechanism 23. Pivot connection 44, is also used to support a depending link means 45, that serves to mount a painting materials tray 47, in the space below panel 29. Tray 47, has two parallel, rearward-extending support bars 49, that have swingable connections 50, with the associated link means 45. Link means 45, can be pivotably adjusted around pivot connection 44, as indicated by arrows 51, in FIG. 1. Also, tray 47, can be pivotably adjusted around pivot connection 50, such that the tray can be oriented in a horizontal position in different adjusted positions of link means 45.

Link means 45, comprises two spaced apart links, as viewed in FIG. 2. Each link, of link means 45, has an elongated slot 53, extending therealong. Pivot connections 50, extend through the slots 53, such that tray 47, can be selectively raised or lowered to a point relatively close to the lower edge of the panel 29, or relatively far away from the lower edge of panel 29. FIG. 1, shows tray 47, in two positions of adjustment, i.e., a lowered position shown in full lines, and a raised position shown in dashed lines. Link means 45, cooperates with tray support bars 49, to provide two direction adjustment of tray 47. For example, by swinging link means 45, leftward, the tray 47, may be moved rearward, or leftward. By moving pivot connections 50, upward, along the slots 53, the tray 47, can be adjusted upward.

Figure 5:
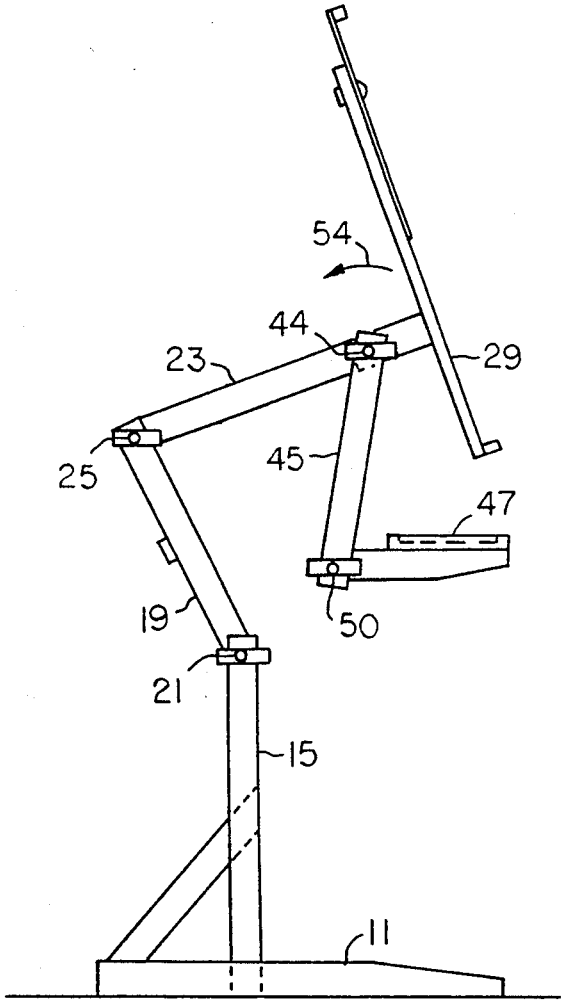
FIG. 5, is a view, taken in the same direction as FIG. 1, but with the easel adjusted for use by a person in a seated position.

FIG. 5, is a view, taken in the same direction as FIG. 1, but with the easel adjusted for use by a person in a seated position.

FIG. 1, shows the easel with panel 29, in a raised position, suitable for use by an artist in a standing position. FIG. 5, shows the easel with panel 29, in a lowered position, that can be used by an artist, while seated in a chair. Articulated arm structure 17, is bent at its mid-connection 25, so as to lower panel 29, toward base 11. Link means 45, is shown slightly swung to the left so that tray 47, is shifted rearward, to a limited extent. The tray 47, can be shifted rearward or forward, without changing the position of panel 29.

Still referring to FIG. 5, panel 29, can be tilted to a more nearly horizontal position, by swinging the panel around pivot connections 44, as indicated by arrow 54.

Figure 6:
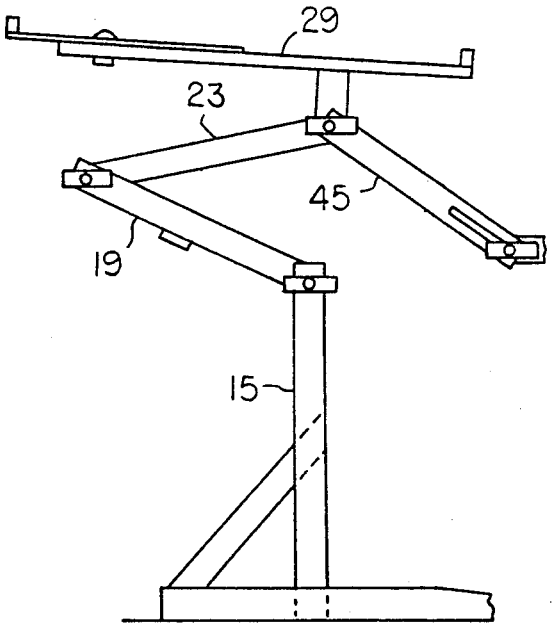
FIG. 6, is a view, taken in the same direction as FIGS. 1 and 5, but showing the canvas frame support panel, in a different position of adjustment.

FIG. 6, is a view, taken in the same direction as FIGS. 1 and 5, but showing the canvas frame support panel, in a different position of adjustment.

FIG. 6, shows a further adjustment of the easel components, wherein the canvas support panel 29, is swung to a horizontal position, and also lowered slightly from the position shown in FIG. 5. Also in FIG. 6, link means 45, is swung forward to extend the tray 47, forward, beyond the front edge of panel 29.

FIG. 7, shows the easel structure adjusted to a position suitable for use by a person seated in a wheelchair, not shown. The articulated arm structure 17, is extended forward, or rightward, so that panel 29, is located rightward, beyond base 11. The artist can then wheel the chair close against base 11, and then be in a position to apply paint directly to the canvas. In FIG. 7, the tray 47, is not shown. The tray 47, is an optional element, that may, or may not, be used by the artist, depending on personal preference.

FIG. 2, is a view taken at right angles to FIG. 1, and showing the construction of pedestal 15, articulated arm structure 17, and link means 45.

Figure 3:
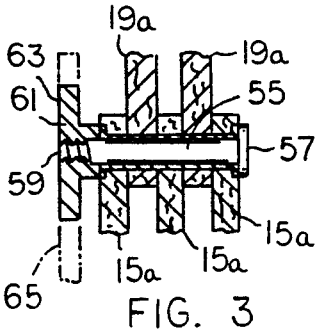
FIG. 3, is an enlarged, fragmentary, cross-sectional view, taken along line 3—3, in FIG. 1.

FIG. 3, is an enlarged, fragmentary, cross-sectional view, taken along line 3—3, in FIG. 1.

Figure 4:
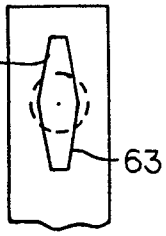
FIG. 4, is a left end view, of the FIG. 3 construction, but with a turning bar added, to increase the turning torque on the illustrated handle.

FIG. 4, is a left end view, of the FIG. 3 construction, but with a turning bar added, to increase the turning torque on the illustrated handle.

FIG. 3, shows a representative pivot construction, that can be used for the various connections, e.g., pivotable connection 21, swingable connection 25, pivotable connection 44, and swingable connection 50.

As shown in FIGS. 1 and 2, base 11, comprises two spaced parallel beams 14, interconnected by crosspieces 16. Pedestal 15, comprises two sets of spaced apart wooden pedestal elements **15*a*, each set comprising three closely spaced flat wooden elements The aforementioned lower arm mechanism 19, comprises two sets of spaced apart lower arms 19*a*. As best seen in FIG. 3, lower arms 19*a*, have their lower ends fitting between the upper ends of pedestal elements 15*a***.

There are two pivotable connections between arm mechanism 19, and pedestal 15. Each pivotable connection comprises a pin, or rod, 55, having a headed end 57, and a threaded end 59. The pin can extend through the bearing sleeves, suitably carried within the various members **15*a* and 19*a*. A clamping nut 61, threads onto pin 55, to exert a clamp force on the overlapped members 15*a* and 19*a*, whereby the lower arm mechanism 19, is held in an adjusted position relative to pedestal 15. As seen in FIG. 4, nut 61, has a non-circular handle 63**.

In order to increase the turning torque on nut 61, an elongated lever 65, may be attached to handle 63. The lever 65, will have a socket opening 66, mated to handle 63, whereby the elongated lever 65, can be temporarily installed on nut 61, when it is desired to turn the nut, for tightening or loosening purposes.

The pivot construction shown in FIG. 3, can be used, in a modified form, for the other pivot connections 25, 44, and 50. Each connection, will require the appropriate length pivot pin, or rod. A common nut-handle design can also be used for the various pivot connections.

As seen in FIG. 2, the articulated arm structure 17, includes two spaced apart upper arms 23, having their lower ends, fitting between the upper ends of the corresponding lower arms 19*a*. The upper ends of arms 23, have pivotable connections 44, with struts 43, and links 45. Pivot connections 44, can be similar to the pivot connections shown in FIG. 3, except for the length of the pivot pins.

The aforementioned panel 29, is preferably comprised of multiple members interconnected, in order to provide four relatively large open spaces 67, extending through the panel thickness dimension. The illustrated panel 29, comprises two side members 29*a*, an upper cross-piece 29*b*, and an intermediate cross-piece 29*c*. Ledge bar 31, forms the lower edge of the panel.

Figure 8:
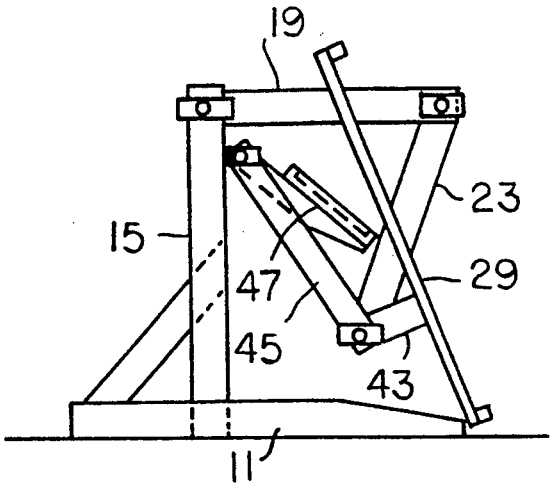
FIG. 8, is a view, taken in the same direction as FIG. 1, but with the easel components folded into a storage condition.

FIG. 8, is a view, taken in the same direction as FIG. 1, but with the easel components folded into a storage condition.

Openings 67, enable the adjustable artist's easel to be folded into the compact shipment or storage configuration, as shown in FIG. 8. As shown, lower arms 19, extend generally parallel to base 11, whereas upper arms 23, extend angularly, from arms 19, towards the base 11, and panel 29, extends angularly in intersecting relation to arms 19 and 23. Openings 67, in the panel enable the panel to fit around the arms, as shown in FIG. 8.

Figure 9:
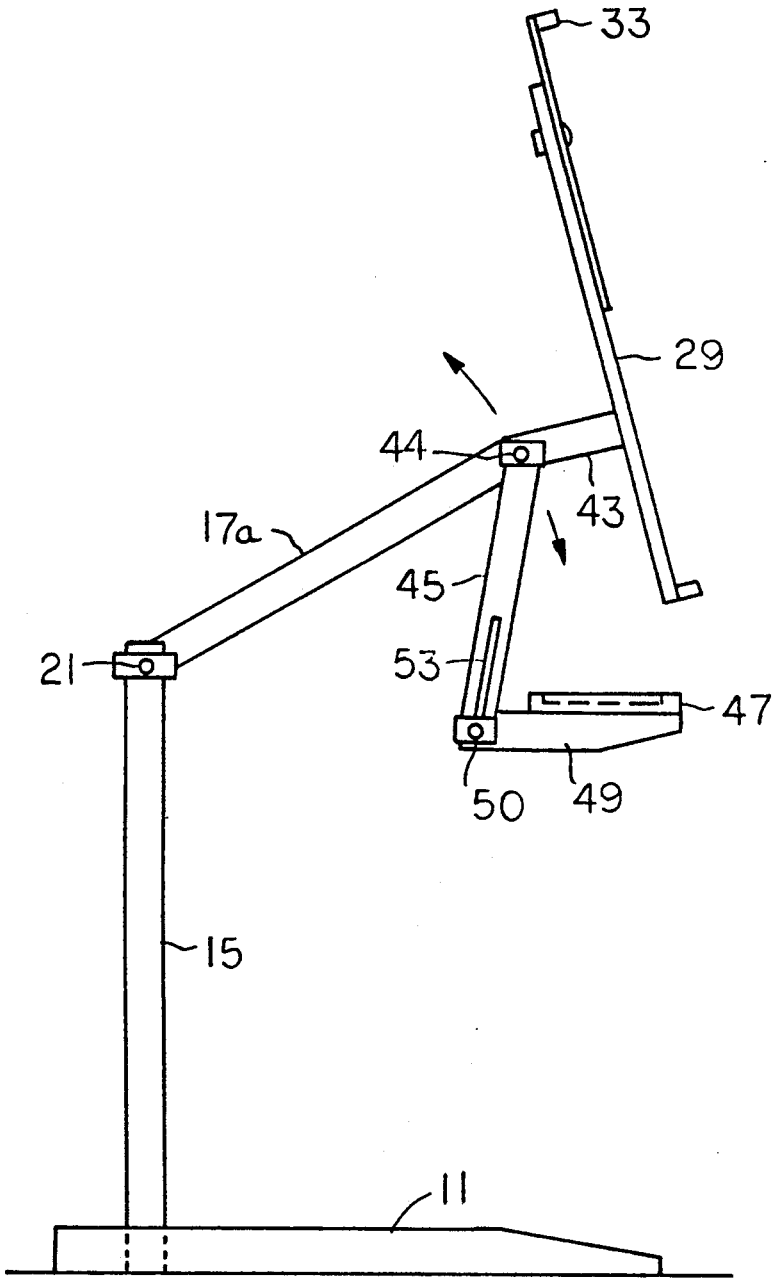
FIG. 9, is a view, taken in the same direction as FIG. 1, but illustrating another embodiment of the present invention.

FIG. 9, is a view, taken in the same direction as FIG. 1, but illustrating another embodiment of the present invention.

FIG. 9, shows an alternate embodiment of the present invention, wherein the pedestal 15, is connected to panel 29, by an arm structure 17*a*, that is of a non-articulated nature. The FIG. 9 construction, has many of the adjustment features possessed by the FIG. 1 construction, but without the storage compactness. FIG. 1, represents the preferred embodiment of the present invention.

It should also be noted, that the embodiments of the present invention, may be constructed of wood, plastic, metal, composite material, or any combination thereof, or any other suitable construction material.

The present invention relates to an adjustable artist's easel. Features of the present invention are recited in the appended claims. The drawings contained herein necessarily depict specific embodiments of the apparatus, useful in practice of the present invention. However, it will also be appreciated by those skilled in the arts pertaining thereto, that the present invention can be practiced in various forms and configurations. Further, the previous detailed descriptions of the preferred embodiments of the present invention, are presented for the purposes of clarity of understanding only, and no unnecessary limitations, should be understood or implied therefrom. Finally, all appropriate mechanical and functional equivalents to the above, which may also be obvious to those skilled in the arts pertaining thereto, are considered to be encompassed within the claims of the present invention.

What is claimed is:

1. An adjustable artist's easel, comprising a base; a pedestal, extending upwardly from said base; said pedestal having an upper end; an articulated arm structure, pivotably connected to said pedestal; said arm structure comprising, a first elongated arm mechanism, having a first pivotable connection to the upper end of said pedestal, and a second elongated arm mechanism, having a swingable connection to said first arm mechanism; said second arm mechanism, having a free end, spaced from said pivotable connection; and a planar picture frame support means, having a second pivotable connection to the free end of said second arm mechanism; the axes of said pivotable connections extending parallel to each other and to the plane of said picture frame support means, whereby said picture frame support means can be tilted to different inclinations around said second pivotable connection, and whereby said picture frame support means can be raised, or lowered, such that an artist can use said easel while standing, or sitting; and the swingable connection between said elongated arm mechanism providing an articulated arm structure, wherein the spacing between said first and second pivotable connection can be varied.

2. The adjustable artist's easel, as described in claim 1, and further comprising, a painting materials tray, having a front end and a rear end; and, a depending link means, having an upper end thereof connected to said second pivotable connection; said link means, having a third pivotable connection to said rear end of said tray, whereby said tray, can be held in a horizontal position, irrespective of the inclination, or elevation, of the picture frame support means.

3. The adjustable artist's easel, as described in claim 2, and further comprising, an adjustment slot means, extending along said link means, whereby said tray, can be raised or lowered along said link means, without changing the position of said picture frame support means.

4. The adjustable artist's easel, as described in claim 3, wherein said depending link means, is independently swingable around said second pivotable connection, whereby said tray can be adjusted in a front-to-rear direction, while maintaining a horizontal position, below said picture frame support means.

5. The adjustable artist's easel, as described in claim 3, wherein said picture frame support means, further comprises, a rectangular panel, having a lower end and an upper end; said panel having a front surface, adapted to receive a picture frame thereon, and a rear surface, having a strut means extending away from the panel plane at an intermediate point between the upper and lower ends of said panel; said second pivotable connection, being located between said arm structure and said strut means.

6. An adjustable artist's easel, comprising, a base; a pedestal extending upwardly from said base; said pedestal comprising two sets of spaced apart pedestal elements, each set comprising three closely spaced pedestal elements; an articulated arm structure, having a first pivotable connection to the upper end of said pedestal; said articulated arm structure comprising two sets of spaced apart lower arms, and two spaced apart upper arms; each set of lower arms comprising two closely spaced arms, having their lower ends fitting between the upper ends of a corresponding set of three pedestal elements; said spaced apart upper arms, having lower ends thereof fitting between the upper ends of a corresponding set of lower arms; and a picture frame support means, having a second pivotable connection with said articulated arm structure; said picture frame support means comprising a rectangular panel, having a front surface and a rear surface, and two spaced apart struts, extending from the panel rear surface; said struts having end portions thereof overlapped with end portions of said upper arms to form said second pivotable connection; said pivotable connections being parallel to each other and to the plane of said picture frame support panel, whereby said support panel, can be tilted, and, also raised or lowered, so that an artist can use the easel while standing or sitting.

7. The adjustable artist's easel, as described in claim 6, and further comprising, a painting materials tray, having a front and rear end, said tray comprising two spaced apart bars; and a depending link means for suspending said tray below the picture frame support panel; said link means comprising two spaced apart link elements, having upper ends thereof overlapped with end portions of said upper arms, in order to form a swingable connection between said articulated arm structure and said depending link means; said tray support bars having end portions thereof overlapped with said link elements to form a second swingable connection between said link means and said tray, whereby said tray can be adjusted in a front-to rear direction, while maintaining a horizontal position below said picture frame support panel.

8. The adjustable artist's easel, as described in claim 1, and further comprising, an adjustment slot means, extending along each depending link means, whereby said tray can be raised, or lowered, along said link means, without changing the position of the picture frame support panel.

9. The adjustable artist's easel, as described in claim 6, wherein said first pivotable connection, further comprises, two separate pivot pins, each said pivot pin, extending transversely through said three pedestal elements and two associated lower arms; said second pivotable connection, further comprising, two separate pivot rods, each said pivot rod, extending transversely through one of said struts and associated said upper arms.

10. The adjustable artist's easel, as described in claim 6, wherein said articulated arm structure, includes a swingable connection, between said lower arms and said upper arms, whereby said arms can be folded, or unfolded, to vary the spacing between said first and said second pivotable connections.

11. The artist's easel, as described in claim 6, wherein said picture frame support panel, has openings therein, enabling the easel to be folded into a storage-ready condition, wherein said lower arms, extend generally parallel to said base, and said upper arms extend from said lower arms, angularly toward the base, and said panel extends angularly in intersecting relation to said upper arms and said lower arms.

12. An adjustable artist's easel, comprising a base; a pedestal extending upwardly from said base, said pedestal having an upper end; an elongated arm structure, having a first pivotable connection to said upper end of said pedestal; said arm structure, having a free end, spaced from said first pivotable connection; a planar picture frame support means, having a second pivotable connection to said free end of said arm structure; the axes of said pivotable connections extending parallel to each other and to the plane of said picture frame support means, whereby said picture frame support means, can be tilted to different inclinations around said second pivotable connection, and whereby said picture frame support means can be raised or lowered, such that an artist can use said easel while standing or sitting; a painting materials tray having a front and a rear end; a depending link means connecting said tray to said picture frame support means; said depending link mans having an upper end thereof, connected to said second pivotable connection; a third pivotable connection between the rear end of said tray and said depending link means, whereby said tray can be held in a horizontal position, irrespective of the inclination or elevation, of said picture frame support means; and said depending link means being independently swingable around said second pivotable connection, whereby said tray can be adjusted in a front-to-rear direction, while maintaining a horizontal position below said picture frame support means.

* * * * *